US007134265B2

(12) United States Patent
Shigemura

(10) Patent No.: US 7,134,265 B2
(45) Date of Patent: Nov. 14, 2006

(54) STRETCHABLE CORE-SHEATH TYPE COMPOSITE YARN AND STRETCHABLE WOVEN-KNIT FABRIC

(75) Inventor: Yukihiro Shigemura, Osaka (JP)

(73) Assignee: Teijin Limited, Osaka (JP)

( * ) Notice: Subject to any disclaimer, the term of this patent is extended or adjusted under 35 U.S.C. 154(b) by 65 days.

(21) Appl. No.: 10/479,248

(22) PCT Filed: Mar. 25, 2003

(86) PCT No.: PCT/JP03/03632

§ 371 (c)(1),
(2), (4) Date: Dec. 1, 2003

(87) PCT Pub. No.: WO03/083194

PCT Pub. Date: Oct. 9, 2003

(65) Prior Publication Data

US 2004/0168426 A1 Sep. 2, 2004

(30) Foreign Application Priority Data

Mar. 29, 2002 (JP) ..... 2002-094558

(51) Int. Cl.
*D02G 3/02* (2006.01)

(52) U.S. Cl. ..... 57/225

(58) Field of Classification Search ..... 57/210, 57/225, 244

See application file for complete search history.

(56) References Cited

U.S. PATENT DOCUMENTS 4,470,250 A * 9/1984 Arenz et al. ..... 57/225
4,554,121 A * 11/1985 Kramers ..... 264/103
5,249,414 A * 10/1993 Iwata et al. ..... 57/225
5,691,057 A * 11/1997 Bennie et al. ..... 428/373
6,240,716 B1 * 6/2001 Yanagawase et al. ..... 57/210

FOREIGN PATENT DOCUMENTS

| | | | |
|---|---|---|---|
| JP | 2-91235 | A | 3/1990 |
| JP | 2-91238 | A | 3/1990 |
| JP | 3-174043 | A | 7/1991 |
| JP | 5-272019 | A | 10/1993 |
| JP | 6-316826 | A | 11/1994 |
| JP | 7-70856 | A | 3/1995 |
| JP | 2000-248439 | A | 9/2000 |
| JP | 2001-295148 | A | 10/2001 |
| JP | 2002-13037 | A | 1/2002 |
| JP | 2002-69772 | A | 3/2002 |
| JP | 2002-146641 | A | 5/2002 |

* cited by examiner

*Primary Examiner*—Shaun R. Hurley
(74) *Attorney, Agent, or Firm*—Sughrue Mion, PLLC

(57) ABSTRACT

A core-in-sheath type composite stretch yarn, having excellent stretchability and soft hand and capable of being dyed in dark colors, comprises a core portion constituted from a elastic yarn formed from at least one elastic fiber and having an ultimate elongation of 70% or more and a sheath portion formed from a non-elastic yarn comprising a plurality of non-elastic fibers having an ultimate elongation of 70% or more and surrounding around the core portion, and is useful for producing a woven or knitted stretch fabric having a high stretch percentage and capable of being dyed in dark colors.

8 Claims, No Drawings

STRETCHABLE CORE-SHEATH TYPE COMPOSITE YARN AND STRETCHABLE WOVEN-KNIT FABRIC

TECHNICAL FIELD

The present invention relates to a core-in-sheath type composite stretch yarn and a woven or knitted stretch fabric. More particularly, the present invention relates to a core-in-sheath type composite yarn having excellent stretchability and a soft hand and exhibiting a high bathochromic effect upon being dyed, and a woven or knitted fabric comprising the above-mentioned composite stretch yarn and having an excellent stretchability.

TECHNICAL BACKGROUND

As conventional elastic yarns, polyurethane elastic yarns and polyetherester elastic yarns are well known. These conventional elastic yarns have a problem that when a fabric is formed from a single type of elastic yarn, the resultant fabric exhibits an insufficient bulkiness and an unsatisfactory handling property. As means for solving the problem, it is known that the above-mentioned elastic yarn and a low elongation yarn having an ultimate elongation of 40% or less are used to provide a covering yarn in which the low elongation yarn is wound around the elastic yarn, a doubled and twisted yarn of the elastic yarn with the low elongation yarn, a mixed fiber yarn in which the elastic yarn is located in a core portion and the low elongation yarn is arranged in a sheath portion around the core portion, or a composite false-twisted yarn prepared by applying a false-twisting treatment to the mixed fiber yarn. For example, Japanese Unexamined Patent Publication No. 03-174,043 discloses a composite textured stretch yarn having a core portion formed from a block copolymerized polyetherpolyester elastic yarn constituted from hard segments comprising a polybutylene terephthalate polyester and soft segments comprising a polyoxybutyleneglycol polyether, and an outer layer portion (sheath portion) formed from a non-elastic, thermoplastic polymer multifilament yarn.

The above-mentioned conventional composite yarns have excellent stretchability. However, these conventional composite yarns are unsatisfactory in soft hand and color density-increasing (bathochromatic) effect, in practice. Thus, the enhancement of the above-mentioned properties and effect of the composite yarn is desired.

SUMMARY OF THE INVENTION

An object of the present invention is to provide a core-in-sheath type composite stretch yarn and a woven or knitted stretch fabric having a stretchability sufficiently high in practice and further a soft hand and a high bathochromic effect.

The core-in-sheath type composite stretch yarn of the present invention comprises:

a core portion formed from an elastic yarn comprising at least one elastic fiber and having an ultimate elongation of 70% or more, and a sheath portion formed from a non-elastic yarn comprising a plurality of non-elastic fibers, having an ultimate elongation of 70% or more, and surrounding the core portion.

In the core-in-sheath type composite stretch yarn of the present invention, the elastic fiber for the core portion is preferably selected from polyurethane elastic fibers and polyetherester elastic fibers.

In the core-in-sheath type composite stretch yarn of the present invention, the non-elastic fibers for the sheath portion are preferably selected from polyester fibers, polyamide fibers and polyolefin fibers.

In the core-in-sheath type composite stretch yarn of the present invention, the fibers in the elastic yarn from which the core portion is formed and the fibers in the non-elastic yarn from which the sheath portion is formed, may be interlaced with each other.

In the core-in-sheath type composite stretch yarn of the present invention, the non-elastic yarn from which the sheath portion is formed may be spirally wound around the elastic yarn from which the core portion is formed.

The woven or knitted stretch fabric of the-present invention comprises the core-in-sheath type composite stretch yarn of the present invention as defined above.

The woven or knitted stretch fabric of the present invention preferably has stretch percentages in warp and weft directions of 10% or more, determined in accordance with JIS L 1096, 8.14.1 Stretch Percentage, (2) Method B (Constant Load Method).

The woven or knitted stretch fabric of the present invention, is preferably dyeable a dark black color having a lightness L* value of 12 or less determined in accordance with CIE 1976.

BEST MODE FOR CARRYING OUT THE INVENTION

The core-in-sheath type composite stretch yarn of the present invention comprises a core portion formed from an elastic yarn and a sheath portion formed from a non-elastic yarn. The elastic yarn from which the core portion is formed comprises at least one elastic fiber and has an ultimate elongation of 70% or more, preferably 110% or more, more preferably 120 to 150%. There is no limitation to the type, composition, thickness and properties of the elastic fiber from which the elastic yarn is formed, as long as the elastic yarn for the core portion and formed from the elastic fiber has the above-mentioned ultimate elongation. The elastic fiber usable for the composite yarn of the present invention includes, for example, polyurethane elastic fibers and polyetherester elastic fibers. Among them, the elastic fibers formed from polyether-polyester block copolymers exhibit excellent wet-heat resistance, alkali resistance and heat-setting property in dimensions and form, and therefore are preferably used for the present invention.

The polyetherester block copolymer refers to a copolymer comprising aromatic polyester units as hard segments and poly(alkyleneoxide)glycol units as soft segments.

To provide the aromatic polyester units from which the hard segments are constituted, polyesters of which an acid component comprises at least one member selected from terephthalic acid, 2,6-naphtalene dicarboxylic acid and 4,4'-diphenyl-dicarboxylic acid, in a content of 80 molar % or more, preferably 90 molar % or more, based on the total molar amount of the acid component, and a glycol component comprises at least one low molecular weight glycol compound selected from 1,4-butanediol, ethylene glycol and 1,3-propanediol, in a content of 80 molar % or more, preferably 90 molar % or more, based on the total molar amount of the glycol component, are preferably used.

Also, to provide the poly(alkyleneoxide)glycol units from which the soft segments are constituted, homopolymers of polyethyleneglycol, poly(propyleneoxide)glycol, and poly (tetramethyleneoxide)glycol, preferably poly(tetramethyleneoxide)glycol, or random copolymers or block copolymers in which two or more of the repeating units selected from the repeating units of the above-mentioned homopolymers are random- or block-copolymerized, or mixtures of two or more of the above-mentioned homopolymers and copolymers, are preferably used.

The poly(alkylenoxide)glycol units from which the soft segments of the elastic polymer are constituted, preferably have an average molecular weight of 400 to 4,000, more preferably 600 to 3,500. When the average molecular weight is less than 400, the resultant polyetherester block copolymer may have insufficient soft segment blocks and thus the resultant copolymer may exhibit an insufficient elastic performance. Also, if the average molecular weight is more than 4,000, the polymer from which the soft segments are formed causes polymer from which the hard segments are formed to be phase-separated, and thus the production of the block copolymer becomes difficult. In this case, even if the block copolymer is produced, the resultant copolymer may exhibit an insufficient elastic performance.

The above-mentioned polyetherester block copolymer can be produced in accordance with a conventional copolymerized polyester-producing process. Particularly, the above-mentioned acid component and/or an alkyl ester of the acid component, and the low molecular weight glycol and poly(alkyleneoxide)glycol are placed in a reactor, and subjected to a transesterification reaction or esterification reaction in the presence or the absence of a catalyst, and the reaction product is subjected to a poly-condensation reaction under a high vacuum. The polycondensation reaction is continued until the degree of polymerization of the resultant copolymer reaches a target degree.

The fibers in the elastic yarn from which the core portion is formed may be in any form of a filament and a staple fiber, and is preferably in the form of a filament (continuous fiber), to keep the wearing comfort of a resultant fabric at a high level. The filament yarn may be a multifilament yarn or a monofilament yarn. There is no limitation to the total thickness of the elastic yarn from which the core portion is formed. To provide high wearing comfort in the resultant fabric, the elastic yarn preferably has a total thickness in the range of from 33 to 110 dtex. By forming the core portion from the above-mentioned elastic yarn, the resultant composite yarn can exhibit a satisfactory stretchability.

In the core-in-sheath type composite stretch yarn of the present invention, the non-elastic yarn, from which the sheath portion is formed, must be formed from non-elastic fibers having an ultimate elongation of 70% or more, preferably 110% or more, more preferably 120 to 150%. If the ultimate elongation is less than 70%, the resultant composite yarn is unsatisfactory in soft hand and bathochromic effect thereof.

The non-elastic fibers for the sheath portion of the composite yarn of the present invention can be produced from fiber-forming, thermoplastic, non-elastic polymers by a melt-spinning procedure. The non-elastic polymers include thermoplastic polymers, for example, polyesters, polyamides (nylon 6, nylon 66, etc.) and polyolefins (polyethylene, polypropylene, etc.). Preferably, fiber-forming polyesters are used for the non-elastic fibers.

The fiber-forming polyesters are preferably selected from polyethylene terephthalate polyesters containing, as main repeating units, ethylene terephthalate units, and polybutyleneterephthalate polyesters containing, as main repeating units, butylene terephthalate units.

The above-mentioned polyethylene terephthalate or polybutylene terephtalate polyesters optionally contains a small amount (usually less than 30 molar %) of copolymerizing components. As a copolymerizing dicarboxylic acid component, for example, isophthalic acid, diphenyl-dicarboxylic acid, naphthalene dicarboxylic acids, 5-sodium sulfoisophthalic acid, adipic acid, and sebacic acid are usable, and/or as a copolymerizing hydroxycarboxylic acid component, for example, p-hydroxybenzoic acid and p-(β-hydroxy) benzoic acid are usable. Also, as a copolymerizing diol component, trimethylene glycol, hexamethylene glycol, neopentylglycol, bisphenol A (including addition products of bisphenol A with ethylene oxide addition-reacted to phenolic hydroxyl groups of bisphenol A), polyethylene glycol and polytetramethylene glycol, are usable.

The fiber-forming, thermoplastic, non-elastic polymer optionally contains at least one additive selected from a fine-pore-forming agent, a cationic dyeability-enhancing agent, a discoloration-preventing agent, a thermal stabilizer, a flame retardant, a fluorescent brightening agent, a delustering agent, a coloring material, an antistatic agent, a moisture-absorbing agent, an antibacterial agent and inorganic fine particles, unless the object of the present invention is obstructed.

The fibers in the non-elastic yarn, from which the sheath portion of the composite yarn of the present invention is formed, may be in either form of filaments or staple fibers. To provide a high wearing comfortablility of the fabric product obtained from the resultant composite yarn, the non-elastic yarn is preferably in the form of a multifilament yarn. Also, there is no limitation to the total thickness and the individual fiber thickness of the non-elastic yarn for the sheath portion. To provide a high degree of comfort upon wearing the resultant fabric product, preferably, the total thickness of the non-elastic yarn is in the range of from 33 to 330 dtex and the individual non-elastic fiber thickness is in the range of from 1 to 5 dtex. Further, there is no limitation to the cross-sectional profile of the individual fibers from which the sheath portion is formed. The cross-sectional profile may be in a conventional form, for example, circular, or a triangular form. The non-elastic individual fibers may be hollow fibers.

The non-elastic fibers, from which the sheath portion is produced, are produced from the above-mentioned fiber-forming, thermoplastic, non-elastic polymer while the fiber-forming conditions are adequately adjusted.

In the composite yarn of the present invention, polyester fiber yarns which exhibit a self-elongating property upon heating in the production process for the composite yarn and/or the production process of the stretch woven or knitted fabric, are preferably used as fiber yarns for forming the sheath portion, to enhance the bulkiness of the stretch woven or knitted fabric of the present invention. The fibers having a self-elongating property are fibers having a dry heat hank shrinkage of less than 0% (namely a hank elongation of more than 0%), preferably −1% or less (namely a hank elongation of 1% or more) measured at a temperature of 180° C. in accordance with JIS L 1013, Dry Heat Shrinkage measurement, Hank shrinkage (A) method. The polyester fiber yarn having the above-mentioned self-elongating property is preferably selected from relax heat-treated, undrawn polyester fiber yarns (low orientation fiber yarns). When the sheath portion is constituted from the relax heat-treated undrawn polyester fiber yarn, a stretch woven or knitted fabric having excellent bulkiness, a high bathochromic property and a soft hand can be obtained. The undrawn polyester fiber yarn having the above-mentioned self-elongating property can be produced by melt-spinning the above-mentioned fiber-forming polyester; winding the resultant undrawn filaments at a speed of 2000 to 4300 m/minute; and heat-treating the resultant undrawn filaments by using a heater heated at a temperature of 180 to 200° C. under a relaxed condition (overfeed rate: 1.5 to 10%).

In the core-in-sheath type composite stretch yarn of the present invention, preferably, the mass ratio, of the elastic yarn from which the core portion is formed to the non-elastic yarn from which the sheath portion is formed, is in the range of from 1:15 to 1:5, more preferably from 1:10 to 1:5.

There is no limitation to the process for producing the core-in-sheath composite yarn of the present invention. The process for producing the composite yarn of the present invention includes a covering method in which a non-elastic yarn for forming the sheath portion is spirally wound around an elastic yarn for forming the core portion; an air blast fiber-mixing method in which the elastic fibers in the core portion and the non-elastic fibers in the sheath portion are partially interlaced each other by using an air nozzle; and a composite false-twisting method in which the elastic fibers in the core portion and the non-elastic fibers in the sheath portion are partially interlaced each other. Among these methods, the air blast-fiber mixing method is preferred. By employing the air blast-fiber mixing methods, the core-in-sheath type composite stretch yarn of the present invention having a soft hand and a high bathochromic property, which are principal target properties of the composite yarn of the present invention, can be easily produced.

The core-in-sheath type composite stretch yarn of the present invention optionally contains another type of yarn, for example, another elastic yarn, a high elongation yarn and/or a low elongation yarn, unless the principal targets of a soft hand, a high bathochromic property and a high stretchability of the present invention, are obstructed.

The stretch woven or knitted fabric of the present invention is provided from the core-in-sheath type composite stretch yarn of the present invention, preferably in an amount of 30% by mass or more. The core-in-sheath type composite stretch yarn may be one twisted at the twist number of 300 to 2500 turns/m. The stretch woven or knitted fabric of the present invention may be formed from the core-in-sheath type composite stretch yarn of the present invention alone or a union woven or knitted fabric of the composite yarn of the present invention with another type of yarn. There is no limitation to the weaving or knitting structure of the composite stretch woven or knitted fabric. The structure may be selected from conventional structures for conventional stretch woven or knitted fabrics.

The stretch woven or knitted fabric of the present invention preferably has a stretch percentage in warp direction of 10% or more, more preferably 20% or more, and a stretch percentage in weft direction of 10% or more, more preferably 20% or more, determined in accordance with JIS L 1096, 8.14.1 Stretch Percentage, (2) Method (B) (Constant Load Method). In the measurement of the stretch percentages of the stretch woven fabric in accordance with the method (B), the stretch percentage in the warp direction and that in the weft direction must be measured separately and not simultaneously.

The stretch woven or knitted fabric of the present invention is preferably dyeable in a dark black color having a lightness L* value of 12 or less, more preferably 11.5 or less, determined in accordance with CIE 1976. The above-mentioned L* value is an indicator showing the bathochromic effect of the woven or knitted fabric, and is determined in accordance with CIE 1976 (L*a*b* color system) indicated in JIS Z 8729 (Indication method of object colors by L*a*b* color system and L*u*v* color system).

The stretch woven or knitted fabric of the present invention is optionally processed by scouring, pre-heat setting, dyeing, final heat-setting, nap-raising and/or embossing. When the composite stretch yarn contains a polyester yarn, the stretch woven or knitted fabric may be treated by a weight-reduction treatment with an alkali, preferably at a weight reduction of 10 to 30%, more preferably 25%.

EXAMPLES

The core-in-sheath type composite stretch yarn and stretch woven or knitted fabric of the present invention will be further illustrated by the following examples.

In the examples, the properties of the yarns and fabrics were determined by the following measurements.

(1) Ultimate Elongation

The ultimate elongations of yarns and fibers to be tested were measured in accordance with JIS L 1013, Testing method of breaking strength and elongation percentage in standard conditions.

(2) Stretch Percentage of Stretch Woven or Knitted Fabric

The Stretch Percentage of Stretch Woven or Knitted Fabric was Determined in Accordance with JIS L 1096, testing method of stretch percentage of stretch woven fabric, B method (Constant load method).

(3) Lightness L* Value

The lightness L* value of dyed woven or knitted fabrics was indicated in accordance with JIS Z 8729, CIF 1976 (L*a*b* color system).

(4) Soft hand and bulky touch of stretch woven or knitted fabrics were evaluated, by a panel consisting of three inspectors, by an organoleptic test. The evaluation data were averaged and the average was represented in the following three classes.

| Class | Evaluation | |
|---|---|---|
| 3 | Excellent | Very practically applicable |
| 2 | Good | Practically applicable |
| 1 | Bad | Not practically applicable |

(5) Shrinkage in Hot Water

The shrinkage in hot-water of elastic filaments was measured in accordance with JIS L 1013, testing method of shrinkage of filaments (B method).

(6) Self Elongating Property

The self elongation percentage of yarns to be tested was measured in accordance with JIS L 1013, testing method of shrinkage percentage of a yarn hank (A method) at a dry temperature of 100° C. and calculated in accordance with the following equation.

$$Ed(\%) = \frac{l_i - l}{l} \times 100$$

wherein Ed represents a dry heat elongation percentage, 1 represents a length of a yarn in the form of a hank before dry heating and $l_1$ represents a length of the yarn after dry heating.

Example 1

An undrawn polyethylene terephthalate multifilament yarn (yarn count: 90 dtex/70 filaments) having an ultimate elongation of 135% and a titanium dioxide content of 2.5% by mass was heat-treated in a relaxed condition by using a heater at a temperature of 190° C., to prepare a non-elastic yarn for a sheath portion, having an ultimate elongation of 125% and a shrinkage in hot water of 2%. The undrawn polyethylene terephthalate multifilament yarn was produced at a melt-spinning speed of 3200 m/minute, and the relax-heat treated yarn prepared from the undrawn yarn had a dry heat self elongation of 1.8%.

Separately, an undrawn polyetherester multifilament yarn (yarn count: 44 dtex/1 filament) having an ultimate elongation of 650% was drawn at a draw ratio of 2.5 at room temperature, to prepare an elastic monofilament yarn for a core portion having an ultimate elongation of 250%, a yarn count of 17.6 dtex/1 filament.

The non-elastic yarn for the sheath portion and the elastic monofilament yarn for a core portion were doubled and fed into an air blast fiber-mixing apparatus, while the feed speed of the non-elastic yarn for the sheath portion was controlled to 1.03 times the feed speed of the elastic yarn for the core portion, and in the fiber-mixing apparatuses, an air blast was blown toward the doubled yarns to form a core-in-sheath type composite stretch yarn in which the core portion was constituted from the elastic yarn for the core portion, and the sheath portion was constituted from the non-elastic yarn for the sheath portion, the elastic filament and the non-elastic filaments being partially interlaced each other. In the resultant composite yarn, the mass ratio of the elastic yarn in the core portion to the non-elastic yarn in the sheath portion was 1:5.2.

The resultant core-in-sheath type composite stretch yarn was subjected to a twisting procedure at a twist number of 800 turns/m. From the twisted composite yarn alone, a woven fabric having a plain weave structure with a warp density of 50 warps/cm and a weft density of 45 wefts/cm was produced. The woven fabric was treated in hot water at a temperature of 80° C., high pressure-wet treated at a temperature of 110° C., dry heat-treated at a temperature of 190° C., and then subjected to a weight-reduction treatment with an alkali solution at a weight reduction of 15%. The resultant woven fabric was subjected to a dyeing procedure with a disperse black dyestuff at a temperature of 135° C., and the dyed fabric was dry heat-treated at a temperature of 170° C. A black-dyed stretch woven fabric was obtained.

The stretch woven fabric was subjected to the measurements of elongation percentage and lightness L* value. The black-dyed stretch woven fabric exhibited a stretch percentage of 25% in the warp direction and 20% in the weft direction, and thus had a sufficient stretchability in practical use. The black-dyed stretch woven fabric exhibited a lightness* value of 11.5. Thus, it was confirmed that the stretch woven fabric had a sufficient bathochromic effect in practical use. The resultant stretch woven fabric exhibited a soft hand and a bulky touch both evaluated in class 3.

Example 2

By the same procedures as in Example 1, but with the following exceptions, a core-in-sheath type composite stretch yarn was produced, a stretch woven fabric was produced from the yarn and then a black-dyed stretch woven fabric was produced from the fabric.

An undrawn elastic polyurethane yarn (yarn count: 44 dtex/3 filaments) having an ultimate elongation of 800% was drawn at a draw ratio of 2.5 at room temperature, to prepare an elastic yarn having an ultimate elongation of 350% and a yarn count of 17.8 dtex/3 filaments. This elastic yarn was used to form the core portion. In the resultant core-in-sheath type composite stretch yarn, the mass ratio of the elastic yarn for the core portion to the non-elastic yarn for the sheath portion was 1:5.2.

The resultant stretch woven fabric exhibited stretch percentages of 25% in the warp direction and 23% in the weft direction, and thus the stretchability of the fabric was sufficient in practice. Also, the black-dyed stretch woven fabric had a lightness L* value of 11.8, and the bathochromic effect of the stretch woven fabric was sufficient in practice. Further, the resultant stretch woven fabric exhibited a soft hand and a bulky touch evaluated in class 3.

Example 3

By the same procedures as in Example 1, but with the following exceptions, a core-in-sheath type composite stretch yarn was produced, a stretch woven fabric was produced from the yarn and then a black-dyed stretch woven fabric was produced from the fabric.

After doubling of the elastic yarn with the non-elastic yarn, the elastic and non-elastic yarns were fed into a covering machine to spirally wind the non-elastic yarn around the elastic yarn. The number of windings of the non-elastic yarn was 1200 turns/m. In the resultant core-in-sheath type composite stretch yarn, the mass ratio of the elastic yarn for the core portion to the non-elastic yarn for the sheath portion was 1:5.2.

The resultant stretch woven fabric exhibited stretch percentages of 24% in the warp direction and 23% in the weft direction, and thus the stretchability of the fabric was sufficient in practice. Also, the black-dyed stretch woven fabric had a lightness L* value of 13.8, and a slight unevenness of the black color due to difference in dye absorption was found on the woven fabric surface. Further, the resultant stretch woven fabric exhibited a soft hand and a bulky touch evaluated in class 3.

Example 4

By the same procedures as in Example 1, but with the following exceptions, a core-in-sheath type composite stretch yarn was produced, a stretch woven fabric was produced from the yarn and then a black-dyed stretch woven fabric was produced from the fabric.

In place of the air blast fiber-mixing apparatus, a yarn-combining machine and a twisting machine were employed. The elastic yarn and the non-elastic yarn were doubled in the yarn-combining machine and the doubled yarn was fed into the twisting machine in which the doubled yarn was subjected to twisting procedure at a twist number of 1200 turns/m so that the non-elastic yarn for the sheath portion was spirally wound around the elastic yarn so that the core portion to covered the elastic yarn.

The resultant stretch woven fabric exhibited stretch percentages of 23% in the warp direction and 24% in the weft direction, and thus the stretchability of the fabric was sufficient in practice. Also, the black-dyed stretch woven fabric had a lightness L* value of 13.7, and a slight unevenness of the black color was found on the woven fabric. Further, the resultant stretch woven fabric exhibited a soft hand and a bulky touch evaluated in class 3.

Comparative Example 1

By the same procedures as in Example 1, but with the following exceptions, a core-in-sheath type composite stretch yarn was produced, a stretch woven fabric was produced from the yarn and then a black-dyed stretch woven fabric was produced from the fabric.

In the production of the core-in-sheath type composite stretch yarn, a drawn polyethylene terephthalate multifilament yarn (yarn count: 90 dtex/70 filaments) having an ultimate elongation of 38% and a titanium dioxide content of 2.5% by mass was employed as a yarn for forming the sheath portion. The multifilament yarn for the sheath portion had a dry heat shrinkage of 56%.

The resultant stretch woven fabric produced from the core-in-sheath type composite yarn exhibited stretch percentages of 19% in the warp direction and 21% in the weft direction, and the stretchability of the fabric was sufficient. However, the black-dyed stretch woven fabric had a lightness L* value of 15.7, and the bathochromic effect of the stretch woven fabric was insufficient. Further, the resultant stretch woven fabric exhibited insufficient soft hand and bulky touch.

INDUSTRIAL APPLICABILITY

The present invention provides a core-in-sheath type composite stretch yarn and a stretch woven or knitted fabric having a soft hand, and a high bathochromic effect, in combination with excellent stretchability.

The invention claimed is:

1. A core-in-sheath composite stretch yarn comprising:

a core portion formed from an elastic yarn comprising at least one type elastic fibers and having an ultimate elongation of 70% or more, and a sheath portion formed from a non-elastic yarn comprising a plurality of relax heat-treated but undrawn non-elastic polyester fibers, having a self-elongation of more than 0% determined at 180° C. in accordance with JIS L 1013, Dry Heat Shrinkage Measurement, Hank Shrinkage (A) Method having a self-elongation property upon heating and an ultimate elongation of 70% or more, and surrounding the core portion.

2. The core-in-sheath composite stretch yarn as claimed in claim 1, wherein the elastic fiber for the core portion is selected from polyurethane elastic fibers and polyetherester elastic fibers.

3. The core-in-sheath composite stretch yarn as claimed in claim 1, wherein the fibers in the elastic yarn from which the core portion is formed are partially interlaced with the fibers in the non-elastic yarn from which the sheath portion is formed.

4. The core-in-sheath composite stretch yarn as claimed in claim 1, wherein the non-elastic yarn from which the sheath portion is formed is spirally wound around the elastic yarn from which the core portion is formed.

5. The core-in-sheath composite stretch yarn as claimed in claim 1, wherein the self-elongation of the relax heat-treated but undrawn non-elastic polyester fibers at 180° C. is 1.0% or more.

6. A stretch woven or knitted fabric comprising the core-in-sheath composite stretch yarn as claimed in any one of claims 1, 2, 3, 4 and 5.

7. The stretch woven or knitted fabric as claimed in claim 6, having stretch percentages in warp and weft directions of 10% or more, determined in accordance with JIS L 1096, 8.14.1 Stretch Percentage, (2) Method B (Constant Load Method).

8. The stretch woven or knitted fabric as claimed in claim 6, being dyeable in a dark black color having a lightness L* value of 12 or less determined in accordance with CIE 1976.

* * * * *